US008087112B2

(12) United States Patent
Cahaan

(10) Patent No.: US 8,087,112 B2
(45) Date of Patent: Jan. 3, 2012

(54) PORTABLE COLLAPSIBLE STRETCHER

(76) Inventor: Dirk Cahaan, Spring Valley, CA (US)

( * ) Notice: Subject to any disclaimer, the term of this patent is extended or adjusted under 35 U.S.C. 154(b) by 19 days.

(21) Appl. No.: 12/686,275

(22) Filed: Jan. 12, 2010

(65) Prior Publication Data

US 2010/0176619 A1 Jul. 15, 2010

Related U.S. Application Data

(60) Provisional application No. 61/204,931, filed on Jan. 12, 2009.

(51) Int. Cl.
*A61G 1/02* (2006.01)

(52) U.S. Cl. ..... 5/625; 5/627; 280/47.25

(58) Field of Classification Search ..... 5/625–628; 280/47.26, 47.25, 47.131
See application file for complete search history.

(56) References Cited

U.S. PATENT DOCUMENTS

| | | | | |
|---|---|---|---|---|
| 5,179,746 | A | 1/1993 | Rogers | |
| 5,375,277 | A | 12/1994 | Carr et al. | |
| 5,820,141 | A | 10/1998 | Wilkerson et al. | |
| 5,871,220 | A * | 2/1999 | Lombard | 280/79.7 |
| 6,842,923 | B1 * | 1/2005 | Castellani et al. | 5/627 |
| 7,810,190 | B1 | 10/2010 | Antonio | |

* cited by examiner

*Primary Examiner* — Fredrick Conley
(74) *Attorney, Agent, or Firm* — Carr & Ferrell LLP

(57) ABSTRACT

A lightweight, collapsible and portable stretcher for effective use under extreme circumstances such as use in disaster and war affected terrains. The stretcher includes a wheel assembly having an alternative use as a container for the collapsible stretcher. The invention has particular advantages in military or disaster environments in that it allows one person, a carrier, to perform an evacuation of an injured person, whereas prior art stretchers require two or more persons to effectuate an evacuation of an injured person. Additionally, the carrier person can utilize the stretcher to transport or pull an injured person while reserving independent functions of his or her hands. Accordingly, the lightweight collapsible and portable stretcher can be operated hands-free by a single carrier person.

13 Claims, 4 Drawing Sheets

PORTABLE COLLAPSIBLE STRETCHER

CROSS-REFERENCE TO RELATED APPLICATIONS

This application claims the priority benefit of U.S. Provisional Patent Application No. 61/204,931 filed Jan. 12, 2009, which is hereby incorporated by reference.

FIELD OF THE INVENTION

The invention relates generally to a portable stretcher apparatus, and more particularly to a lightweight collapsible stretcher apparatus and methods for effectuating a single-person evacuation of an injured human, animal, or the like.

BACKGROUND OF THE INVENTION

A stretcher is a medical device used to carry casualties or an incapacitated person from one place to another. Various embodiments of stretchers are known and used in the art.

Commercial medical use stretchers are popular and well known devices which function well under most circumstances. These stretchers are commonly used by medical personnel such as paramedics, nurses, and other medical specialists for transporting an injured or incapacitated person from a first location to a second location. Commercial medical use stretchers are often useful when evacuation is effectuated by an ambulance or other motorized vehicle, however because these stretchers are bulky and heavy they require two persons to effectively transport the injured person. Additionally, the wheels on most commercial medical stretchers are designed for use on concrete, tile, and other level and flat ground.

This invention is particularly concerned with the evacuation of injured or incapacitated persons in rural, underdeveloped, disaster, and war affected terrains, where the above-described commercial medical stretchers are incompatible or useless. Currently available stretchers for rural, underdeveloped, disaster and war affected terrains, including those currently used by the U.S. military, require two persons to effectuate an evacuation. Furthermore, these stretchers are excessively bulky, heavy, and difficult to operate under normal extreme conditions presented in disaster and war affected terrains.

SUMMARY OF THE INVENTION

It is therefore and object of the invention to solve these and other problems in the art by providing a lightweight, collapsible and portable stretcher for effective use under extreme circumstances such as use in disaster and war affected terrains. The stretcher comprises a stretcher bed and a wheel assembly. The wheel assembly further comprises a hollow, elongated tubular element, the tubular element functions primarily as an enclosure for containing the stretcher bed; however, the tubular element may also function as a wheel when attached to one end of the stretcher bed. The stretcher bed includes one of telescoping or foldable support rails for collapsible storage of the stretcher bed.

The invention has particular advantages in military or disaster environments in that it allows one person, a carrier, to perform an evacuation of an injured person, whereas prior art stretchers require two or more persons to effectuate an evacuation of an injured person. Additionally, the carrier person can utilize the stretcher to transport or pull an injured person while reserving independent functions of his or her hands. Accordingly, the lightweight collapsible and portable stretcher can be operated hands-free by a single carrier person. As will be understood by one having skill in the art, the hands-free capability enables a soldier to be a carrier of an injured person while maintaining a weapon for defending himself and the injured person.

Other utility of the invention includes use as a game-transport device. For example, where a hunter takes game in a desolate or isolated terrain, the hunter can use the invention to transport the animal from the taking site. The present invention is particularly useful when hunting deer, mouse, hogs, and other large game.

Similarly, the invention can be used to transport other payload, such as food, cargo, ammunitions, clothing, and other goods or supplies.

Although the invention provides a single-carrier solution for transporting a person, animal, or other payload, the invention can also be carried by two or more carrier persons.

BRIEF DESCRIPTION OF THE DRAWINGS

These and other attributes of the invention will become more clear upon a thorough study of the following description of the invention, particularly when reviewed in conjunction with the drawings, wherein.

DETAILED DESCRIPTION

Figure 1:
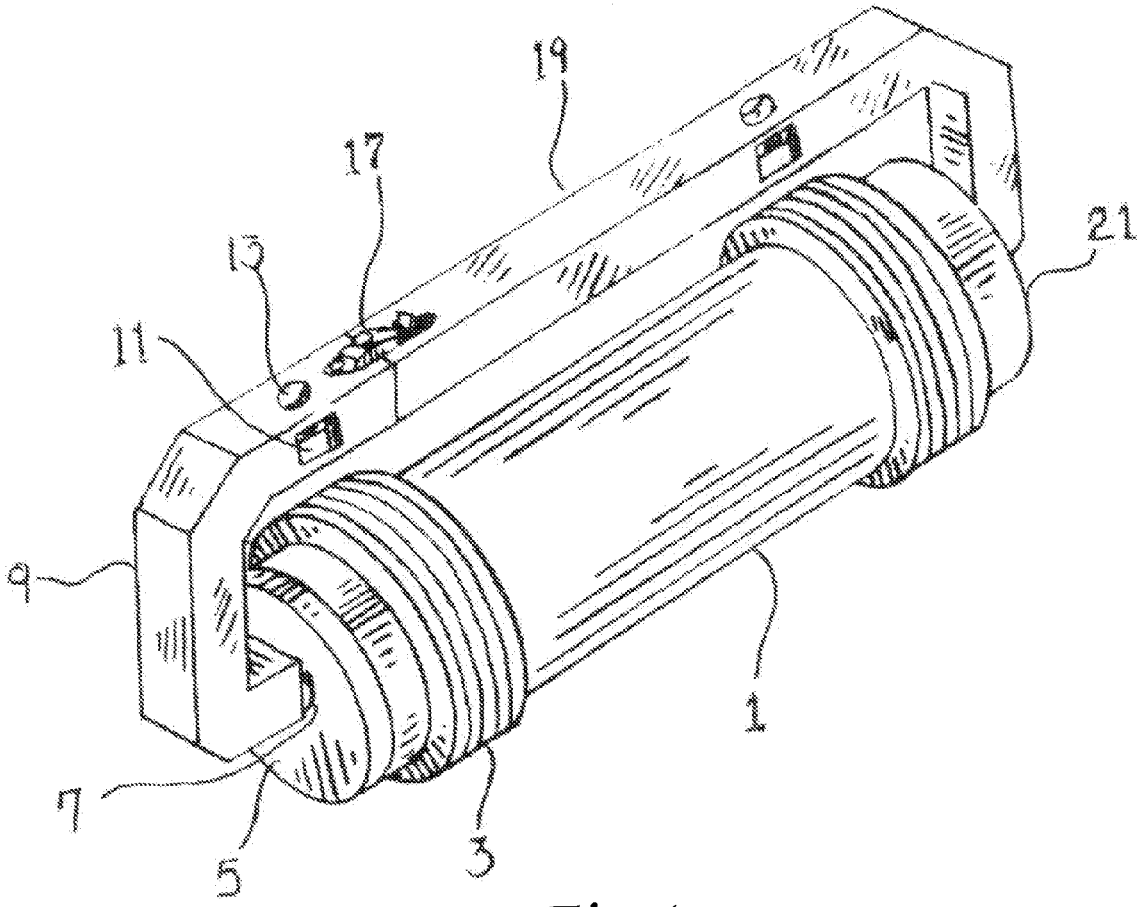
FIG. 1 is a perspective view of the invention in a collapsed and portable embodiment, where a stretcher bed is collapsed and contained within a wheel assembly.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

The invention includes a lightweight, portable and collapsible stretcher for use in transporting a payload or incapacitated subject to a destination. In a general embodiment of the invention, the stretcher includes a stretcher bed assembly and a wheel assembly. The stretcher bed assembly generally includes two collapsible and expandable rails and a sheet for attachment therebetween. The wheel assembly generally includes an elongated tubular element having a base and a hollowed body for use as a wheel, and a container.

The wheel assembly can be used as a container to store and carry the stretcher bed assembly. The stretcher bed assembly collapses at the rails, and may further fold into a collapsed state, where the stretcher bed assembly is adapted to fit into and be substantially contained within the hollowed body of the wheel assembly.

In one embodiment, as illustrated in FIG. 1 of the appended drawings, a wheel assembly is provided for containing a portable stretcher. The wheel assembly includes an elongated tubular element 1 having one or more tread sleeves 3 attached to an outer surface of the elongated tubular element, a detachable end cap 5 for closing an open end of the elongated tubular element, a wheel arm having a first portion 9 and a second portion 19, and one or more bearings 7 to rotatably attach the wheel arm and the elongated tubular element.

The first portion 9 of the wheel arm is attached to the end cap 5 at a bearing 7 for rotational engagement with the wheel arm. The second portion 19 of the wheel arm is attached to the base of the elongated tubular element 1 at a bearing for rotational engagement with the wheel arm. The elongated tubular element is centered about a rotational axis, such that the wheel arm is attached to the elongated tubular element at a bearing disposed along the rotational axis, centered on the base of the elongated tubular element, and again centered on the end cap. The first portion of the wheel arm is adapted to removably attach to the second portion of the wheel arm at a clasp 17. The wheel arm further includes one or more openings 11, 13, for attaching the wheel assembly to a stretcher bed assembly. When attached to a stretcher bed assembly, the wheel assembly of FIG. 1 is adapted to function as a wheel. Additionally, when the stretcher bed assembly is collapsed, the stretcher can fit into the elongated tubular element and become contained by the wheel assembly, where the wheel arm is adapted to further function as a portable carry handle.

Figure 2:
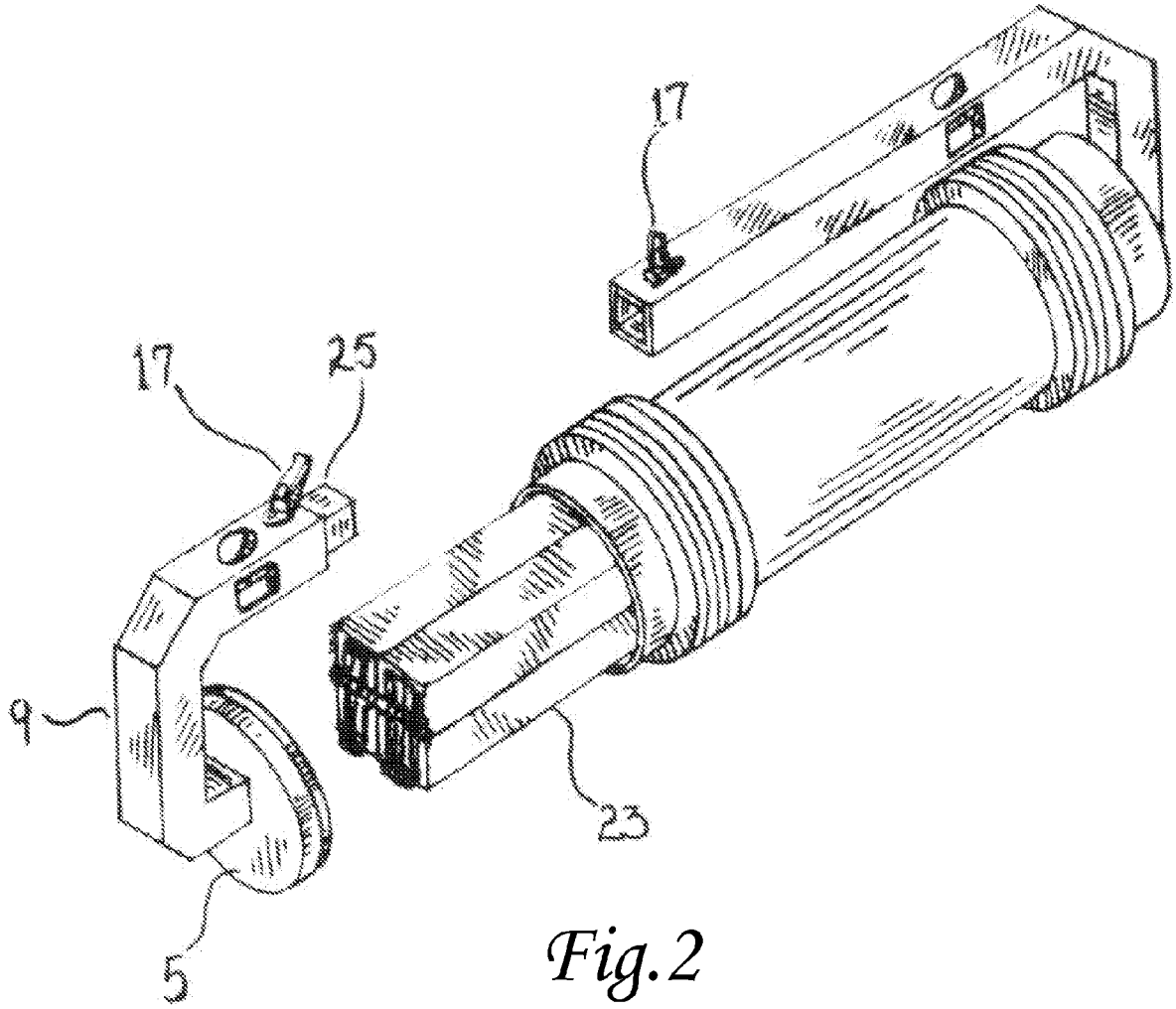
FIG. 2 illustrates a perspective view of the invention, where a first end of the wheel assembly is removed to expose the stretcher bed.

Now turning to FIG. 2, the wheel assembly can be unlatched at the clasp 17, and the first portion of the wheel arm 9 and end cap 5 can be removed from the wheel assembly, as shown. The stretcher 23 can be removed from the wheel assembly and expanded for use as a stretcher. One of the first portion or the second portion of the wheel arm can further include a tapered end 25 for securely fitting the first portion and the second portion of the wheel arm, and further stabilizing and strengthening the wheel arm during use. The wheel arm can be fabricated from a hollow tubular structure, such as a hollow square aluminum to provide a lightweight and rigid structure. Additionally, the wheel arm can be fabricated from any metal, polymer, composite, carbon fiber, or other structural material. The tubing can be square extruded tubing, circle extruded tubing, oval extruded tubing, oblong oval hollow tubing, triangle extruded tubing, or any other hollow tubing material.

Figure 3:
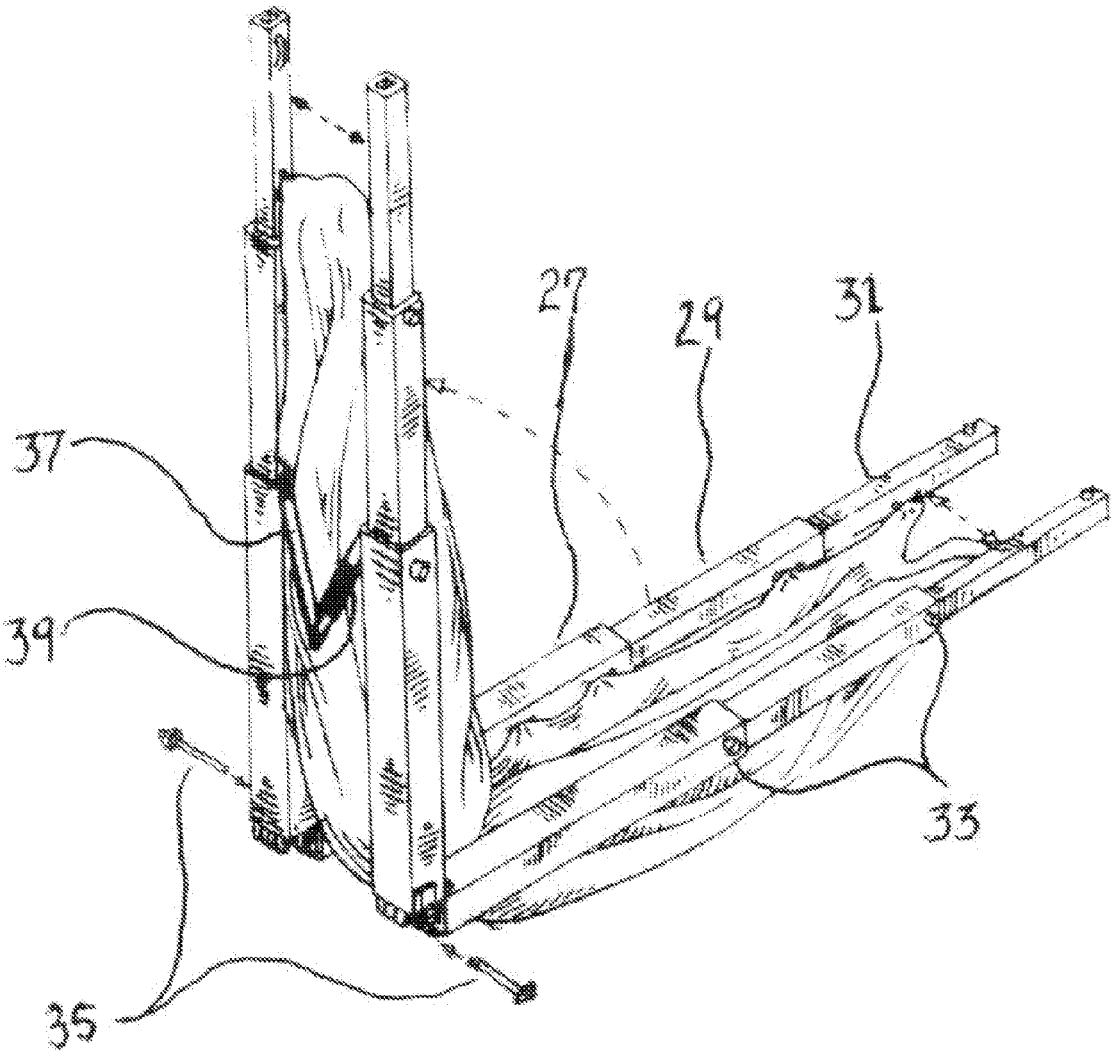
FIG. 3 illustrates a perspective view of the lightweight, collapsible stretcher bed having telescoping support rails.

Once removed from the wheel assembly, or container, the stretcher assembly 23 can be expanded to construct a stretcher bed. The stretcher assembly, as illustrated in FIG. 3, includes two expandable rails and a bed sheet. Each of the two expandable rails may include a plurality of telescoping members 27; 29; 31. Each of the telescoping members may become locked into place by a spring pin 33, to maintain the expanded stretcher in an expanded state. The spring pins are essentially a pin and attached spring for retractably locking the telescoping members into an expanded state. Additionally, each of the two expandable rails may include one or more hinges for folding the rails. The hinges can be locked into place using locking pins 35, such that the stretcher is securely maintained in an expanded state during use. Alternatively, self-locking hinges, such as spring loaded hinges, can be used to form a self-locking expandable stretcher assembly.

The terminal ends of the stretcher bed, and one or more spring pins attached thereon, can be inserted into corresponding openings 11, 13 in the wheel arm of the wheel assembly to securely mount the wheel assembly to the stretcher bed. One or more cross members 37, 39 can be attached to the telescoping rails of the stretcher bed for added support to the bed sheet and maintaining the expanded stretcher bed at an expanded width. The cross members can hinge or fold to minimize the volume of the stretcher bed in the collapsed state. The cross members can further include one or more sleeves for sliding over the cross members to lock the cross members in an expanded state. The bed sheet can be attached to the telescoping rails at a plurality of attachment points. Additionally, the bed sheet can comprise one or more hollow sleeves for inserting the telescoping support rails.

One or both terminal ends of each telescoping collapsible rail can include openings, such that the wheel assembly can be attached at a proximal terminal end of the expanded stretcher bed, and a harness can be attached to a distal end of the expanded stretcher bed assembly. Alternatively, one or more rings can be positioned on a terminal end of a telescoping rail, the rings adapted to engage with a harness or strap for single person transport of the portable stretcher.

Figure 4:
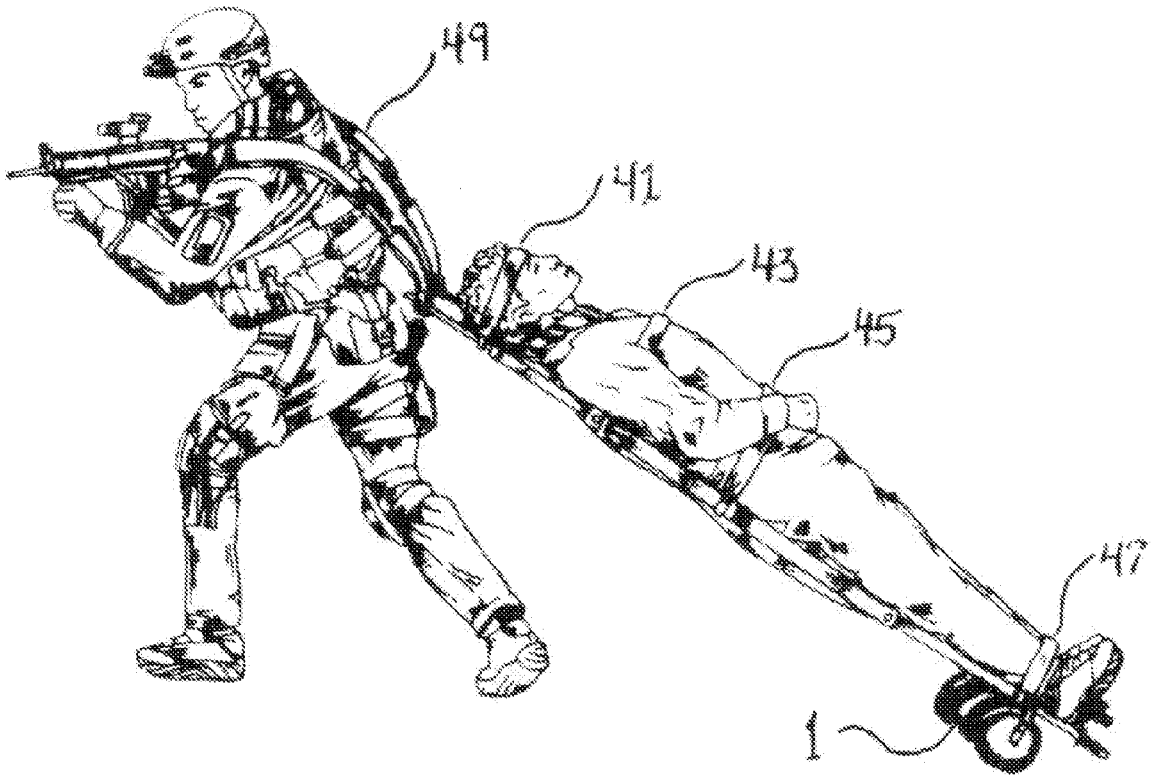
FIG. 4 illustrates a practical application of the lightweight, collapsible stretcher apparatus where an injured person is transported by a carrier person; the carrier person maintaining hands-free operation of the stretcher apparatus, thereby enabling the carrier person to maintain a weapon for protecting himself and the injured person.

FIG. 4 illustrates the portable stretcher according to one embodiment of the invention where the stretcher is adapted to be carried by a single person. The expanded stretcher includes a wheel assembly 1 attached at a proximal terminal end. An incapacitated person is shown positioned on the expanded stretcher; the incapacitated person is secured to the stretcher using a plurality of straps 41; 43; 45; 47 attached to each rail of the stretcher bed. A harness 49 is attached to a distal end of the stretcher bed, and a carrier person is wearing the harness. The carrier person, as illustrated in FIG. 4, can use the harness to tow the stretcher and incapacitated person hands-free, thereby reserving the capability of maintaining a weapon for protecting himself and the incapacitated person.

Assembly of the Stretcher

The wheel assembly, as depicted in FIG. 1, is designed so that the invention can be strapped to a knapsack or backpack, hung from a hook or attached or stored in any of an infinite number of ways.

Referring to FIGS. 1 and 2, to assemble the invention the user unclips the two part clasp and separates the detachable cap and first portion of the wheel arm from the rest of the wheel assembly, exposing the collapsed frame and stretcher bed assembly. The collapsed bed and frame are removed from the elongated tubular member, or wheel tube, and the detachable end cap is re-inserted into the elongated wheel tube so that the wheel assembly arms are re-connected and locked in place by the two part clasp.

Referring to FIG. 3, the stretcher bed frame is then unfolded and the hinges secured into place with the insertion of the locking pins. Alternatively, the hinges can be self-locking using a spring loaded or other self-locking hinge. The user then extends each section of the frame until the spring pins lock each section in position. The two cross members are thereafter extended allowing sleeves to be slid into position in the mid-section of the cross member which prevents the cross member from collapsing and tightens the bed. It should be further noted that the two cross members can alternatively be secured by tension in the fabric, or any other lock, pin, fastener, or locking system.

Referring to FIG. 1, the ends of the frame section containing the terminal end section spring pins 32 are inserted into the wheel assembly arm through the rectangular openings 11 and locked into place by the end spring pins 32 passing through the top openings 13 in the arm. The invention is now locked into place and ready to transport or evacuate a payload or person, respectively.

Method of Use

A user places the injured person on the stretcher as shown in FIG. 4 and uses the appropriate strap position to secure him to the stretcher.

Utilizing the pushing method, the user picks up the end opposite the wheel assembly and pushes the stretcher as one would a wheel barrow.

Utilizing the pulling method, the user grasps the ends of the stretcher by either facing the injured person as he pulls or with his back to him as he pulls.

Utilizing the "hands-free" pulling method, as illustrated in FIG. 4, the user attaches the harness to the stretcher, places each arm through the harness and pulls the stretcher as depicted.

The above examples are set forth for illustrative purposes and are not intended to limit the spirit and scope of the invention. One having skill in the art will recognize that deviations from the aforementioned examples can be created which substantially perform the same tasks and obtain similar results.

I claim:

1. A portable stretcher, comprising:

a stretcher bed including two collapsible rails and a sheet; and a wheel assembly including an elongated tubular element rotatably attached to a wheel arm, the wheel arm receiving the stretcher bed when the stretcher bed is in a collapsed configuration, wherein the wheel arm includes a first portion connected to an end cap and releasably attached to a second portion of the wheel arm, so that when the first portion of the wheel arm is detached from the second portion of the wheel arm, the end cap is removed from the tubular element, thereby providing access to the stretcher bed.

2. The portable stretcher of claim 1, wherein the wheel assembly includes a first bearing and a second bearing to facilitate rotation of the tubular element.

3. The portable stretcher of claim 2, wherein the first portion of the wheel arm is attached to the end cap at the first bearing.

4. The portable stretcher of claim 2, wherein the second portion of the wheel arm is attached to the tubular element at the second bearing.

5. The portable stretcher of claim 1, the wheel assembly further including a clasp positioned on the wheel arm, the clasp being released to detach the first portion of the wheel arm from the second portion of the wheel arm.

6. The portable stretcher of claim 1, wherein the tubular element further includes at least one tread sleeve.

7. The portable stretcher of claim 1, wherein the wheel arm includes an alignment opening to attach the wheel assembly to the stretcher bed.

8. The portable stretcher of claim 7 wherein the alignment opening is substantially rectangular.

9. The portable stretcher of claim 1, wherein the collapsible rails are telescoping rails.

10. The portable stretcher of claim 1, wherein each of the collapsible rails of the stretcher bed includes at least one hinge so that the stretcher bed may be expanded from the collapsed configuration to a deployed configuration.

11. The portable stretcher of claim 1, wherein the tubular element rotates on bearings attached to the wheel arm.

12. The portable stretcher of claim 1, wherein the stretcher bed further includes at least one strap to secure a payload to the stretcher bed.

13. The portable stretcher of claim 1, wherein the stretcher bed further includes a harness attached to an end of the stretcher bed distal to an end of the stretcher bed received in the wheel assembly.

* * * * *